United States Patent [19]

Hettinger, Jr. et al.

[11] 4,412,914

[45] Nov. 1, 1983

[54] ENDOTHERMIC REMOVAL OF COKE DEPOSITED ON SORBENT MATERIALS DURING CARBO-METALLIC OIL CONVERSION

[75] Inventors: William P. Hettinger, Jr., Russell, Ky.; James F. Hoffman, Huntington, W. Va.; Stephen M. Kovach, Ashland, Ky.

[73] Assignee: Ashland Oil, Inc., Ashland, Ky.

[21] Appl. No.: 291,656

[22] Filed: Aug. 10, 1981

[51] Int. Cl.[3] ..... C10G 29/04

[52] U.S. Cl. ..... 208/253; 208/307; 502/38; 502/52

[58] Field of Search ..... 208/253, 307; 252/416, 252/419

[56] References Cited

U.S. PATENT DOCUMENTS

| | | | |
|---|---|---|---|
| 1,915,362 | 6/1933 | Hanks et al. | 252/419 |
| 2,342,856 | 2/1944 | Hall | 252/416 |
| 2,398,739 | 4/1946 | Greensfelder et al. | 252/417 |
| 2,414,002 | 1/1947 | Thomas et al. | 208/164 |
| 2,434,567 | 1/1948 | Johnig et al. | 252/417 |
| 2,464,532 | 3/1949 | Sellers | 252/419 |
| 2,758,098 | 8/1956 | Haensel | 252/416 |
| 3,563,911 | 2/1971 | Pfeiffer et al. | 252/417 |
| 3,919,115 | 11/1975 | Stins et al. | 252/417 |
| 4,066,533 | 1/1978 | Myers et al. | 208/153 |
| 4,070,159 | 1/1978 | Myers et al. | 252/417 |
| 4,176,084 | 11/1979 | Luckenbach | 208/113 |
| 4,243,514 | 1/1981 | Bartholic | 208/153 |
| 4,263,128 | 4/1981 | Bartholic | 208/91 |
| 4,332,673 | 5/1982 | Myers | 208/164 |

*Primary Examiner*—Delbert E. Gantz
*Assistant Examiner*—Helane E. Maull
*Attorney, Agent, or Firm*—Richard C. Willson, Jr.; Carl D. Farnsworth

[57] ABSTRACT

A process is disclosed for decarbonization-demetallization of a poor quality residual oil feed boiling above about 650° F. and comprising substantial Conradson carbon components to provide a higher grade of oil feed by contacting the poor quality oil feed with sorbent particle material containing one or more metal additives selected to catalyze the endothermic removal of coke with $CO_2$. Sorbent decarbonization conditions are selected so that substantial quantities of carbonaceous material and metals are deposited on the sorbent in the decarbonizing zone. Sorbent material with metals and hydrocarbonaceous deposits is regenerated in the presence of an oxygen and carbon dioxide containing gas streams in separate sorbent regeneration zones at a temperature sufficiently elevated to remove residual coke to a desired low level. Regenerated sorbent particle material at an elevated temperature below about 1500° F. is recycled to the poor quality oil feed decarbonizing zone for contact with additional feed. A select metal additive is provided in the sorbent particle material in an amount sufficient to particularly catalyze the endothermic removal of coke in the presence of a carbon dioxide rich gas at a selected sorbent regeneration temperature. A sorbent particle composition suitable for use in the process comprises a kaolin clay containing one or more of the metal additives which may be introduced into the clay during the oil feed decarbonizing process or during sorbent manufacture. Metal additives include water soluble inorganic metal salts and hydrocarbon soluble organo-metallic compounds of a select group of metals.

38 Claims, 4 Drawing Figures

HEAT BALANCE IN RCC UNIT
FUNCTION OF: CON. CARBON, $H_2O$ ADD'N, H IN COKE, $CO_2/CO$ RATIO=1/1

ENDOTHERMIC REMOVAL OF COKE DEPOSITED ON SORBENT MATERIALS DURING CARBO-METALLIC OIL CONVERSION

TECHNICAL FIELD

This invention relates to producing a grade of oil feed having lowered metals and Conradson carbon values for use as feedstocks for reduced crude conversion processes and/or for typical more conventional FCC processes from a poor grade of residual oil comprising carbo-metallic oil resid having undesirably high metals and Conradson carbon values. More particularly, the invention is related to a sorbent material composition containing a select group of metal additive as a free metal, its oxides or its salts in concentrations sufficient to catalyze the endothermic removal of hydrocarbonaceous material deposited on the sorbent composition during decarbonizing and demetallization of the poor grade residual oil. The metal additive may be added during sorbent manufacture, after manufacture by impregnation of virgin sorbent, or at any point in the sorbent cycle for conversion of the oil feed.

BACKGROUND OF THE INVENTION

A major breakthrough in FCC catalysts came in the early 1960's, with the introduction of molecular sieves or zeolites. These materials were incorporated into a matrix of amorphous and/or amorphous/kaolin materials constituting the FCC catalysts of that time. These new zeolitic catalysts, containing a crystalline aluminosilicate zeolite in an amorphous or amorphous/kaolin matrix of silica, alumina, silica-alumina, kaolin, clay or the like were at least 1,000–10,000 times more active for cracking hydrocarbons than the earlier amorphous or amorphous/kaolin containing silica-alumina catalysts. This introduction of zeolitic cracking catalysts revolutionized the fluid catalytic cracking process. New innovations were developed to handle these high activities, such as riser cracking, shortened contact times, new regeneration processes, new improved zeolitic catalyst developments, and the like.

After the introduction of zeolitic containing catalysts the petroleum industry began to suffer from a lack of crude availability as to quantity and quality accompanied by increasing demand for gasoline with increasing octane values. The world crude supply picture changed dramatically in the late 1960's and early 1970's. From a surplus of light, sweet crudes the supply situation changed to a tighter supply with an ever increasing amount of heavier crudes with higher sulfur and nitrogen contents. These heavier and higher sulfur-nitrogen crudes presented processing problems to the petroleum refiner in that these heavier crudes invariably also contained much higher metals and Conradson carbon values, with accompanying significantly increased asphaltic content.

The effects of metal contaminants and Conradson carbon on a zeolite containing FCC catalyst has been described in the literature as to their highly unfavorable effect in lowering catalyst activity and selectivity for producing liquid fuel products comprising gasoline production and their equally harmful effect on catalyst life.

The heavier crude oils also contained more of the heavier compounds comprising asphaltenes and polycyclic compounds that yield less or a lower volume of a high quality FCC gas oil charge stock which normally boil below about 1025° F., and are usually processed, so as to contain total metal levels below 1 ppm, preferably below 0.1 ppm, and Conradson carbon values substantially below 1.0.

However, with an increased supply of the heavier, less desirable crudes, which provide lowered yields of gasoline, and the increasing demand for liquid transportation fuels, the petroleum industry must search for and provide processing schemes to utilize these heavier crudes in producing gasoline and other needed liquid fuel products. Many of these processing schemes have been described in the literature. These include Gulf's Gulfining and Union Oil's Unifining processes for treating residium, UOP's Aurabon process, Hydrocarbon Research's H-Oil process, Exxon's Flexicoking process to produce thermal gasoline and coke, H-Oil's Dynacracking and Phillip's Heavy Oil Cracking (HOC) processes. These processes utilize thermal cracking or hydrotreating followed by FCC or hydrocracking operations to handle the higher content of metal contaminants (Ni-V-Fe-Cu-Na) and high Conradson carbon values of 5–15. Some of the drawbacks of these types of processing are as follows: coking yields thermally cracked gasoline which has a much lower octane value than cat cracked gasoline and is unstable due to the production of gum from diolefins and requires further hydrotreating and reforming to produce a higher octane product; gas oil quality is degraded due to thermal reactions which produce a product containing refractory polynuclear aromatics and high Conradson carbon levels which are highly unsuitable for catalytic cracking; and hydrotreating requires expensive high pressure hydrogen, multi-reactor systems made of special alloys, costly operations, and a separate costly facility for the production of hydrogen.

To better understand the reasons why the industry has progressed along today's processing schemes, one must understand the known and established effects of contaminant metals (Ni-V-Fe-Cu-Na) and Conradson carbon on a zeolite containing cracking catalyst and the operating parameters of a catalytic cracking operation. Metal content and Conradson carbon are two very effective restraints on the operation of a FCC unit and may even impose undesirable restraints on a Reduced Crude Conversion (RCC) unit from the standpoint of obtaining satisfactory conversion, selectivity and catalyst life. Even relatively low levels of these contaminants are highly detrimental to the present day FCC units relying upon zeolite cracking catalysts. As metals and Conradson carbon levels are increased the operating capacity and efficiency of a reduced crude cracking process is also adversely affected or even made uneconomical. These adverse effects occur even though there is enough hydrogen in the feed to produce an ideal gasoline consisting of only toluene and isomeric pentenes (assuming a catalyst with such ideal selectivity could be devised).

The effect of increased Conradson carbon producing components in a cracking feed is to increase that portion of the feedstock normally converted to coke deposited on the catalyst. In typical gas oil operations comprising vacuum gas oils and employing a zeolite containing cracking catalyst in a fluid catalyst cracking unit, the amount of coke deposited on the catalyst averages around about 4–5 wt% of the feed. This coke production has been attributed to four different coking mechanisms, namely, contaminant coke from adverse reactions caused by metal deposits, catalytic coke caused by acid site cracking, entrained hydrocarbons resulting from pore structure adsorption and/or poor stripping, and Conradson carbon resulting from pyrolytic distillation of heavy, high molecular weight hydrocarbons, in the conversion zone. There has also been postulated two other sources of coke from reduced crudes in addition to the four above identified. They are: (1) adsorbed and absorbed high boiling hydrocarbons which do not boil or vaporize at a temperature below 1025° F. and cannot be removed from catalyst particle by the present stripping operations, and (2) high molecular weight nitrogen containing hydrocarbon compounds adsorbed on the catalyst's acid sites. Both of these two new types of coke producing phenomena add greatly to the complexity of residual oil, reduced crude and resid processing. Therefore, in the processing of these high boiling crude oil fractions, e.g., reduced crudes, residual fractions, topped crude, and the like, the coke production based on feed is a summation of the four types present in gas oil processing plus coke obtained from the higher boiling unstrippable hydrocarbons and coke associated with the high boiling nitrogen containing molecules which are adsorbed on the catalyst. Coke production on clean catalyst, when processing reduced crudes, may be roughly estimated as approximately 4 wt% of the feed plus the Conradson carbon value of the heavy feedstock.

The catalyst comprising hydrocarbonaceous deposits of hydrocarbon conversion is brought back to equilibrium activity by burning off the deactivating hydrocarbonaceous material and residual coke in a regeneration zone in the presence of air thereby heating the catalyst to an elevated temperature. The regenerated catalyst at an elevated temperature is recycled back to the reaction zone. The heat generated during burning in the regeneration zone is removed in part by the heated catalyst and carried to the reaction zone for vaporization of the feed and to provide heat for the endothermic cracking reaction. Hot regeneration flue gases also remove a portion of the regeneration heat. The temperature in the regenerator is normally limited below 1600° F. because of metallurgical limitations and the hydrothermal stability of the catalyst.

The hydrothermal stability of a zeolite containing catalyst is determined by the temperature and steam partial pressure at which the zeolite begins to rapidly lose its crystalline structure to yield a lower activity material considered amorphous. The presence of steam is highly critical and is generated by the burning of adsorbed and absorbed (sorbed) carbonaceous material which has a significant hydrogen content (hydrogen to carbon atomic ratios generally greater than about 0.5). This hydrocarbonaceous material deposit is obtained in substantial measure from the high boiling sorbed hydrocarbons and particularly from asphaltic or polycyclic high molecular weight materials which do not vaporize at temperatures below 1025° F. These materials have a modest hydrogen content and include high boiling nitrogen containing hydrocarbons, as well as related high molecular weight porphyrins and asphaltenes. The high molecular weight nitrogen compounds usually do not boil or vaporize below about 1025° F. and may be either basic or acidic in nature. The basic nitrogen compounds tend to neutralize acid cracking sites while those that are more acidic may be attracted to metal sites on the catalyst. The porphyrins and asphaltenes which also do not vaporize at temperatures up to 1025° F., may contain elements other than carbon and hydrogen. As used in this specification, the term "heavy hydrocarbons" includes all carbon and hydrogen containing resid compounds that do not boil or vaporize at a temperature in the range of 650° F. up to 1025° F., regardless of whether other elements are also present in the compound.

The heavy metals in the feed are generally present as porphyrins and/or asphaltenes. However, certain of these metals, particularly iron and copper, may be present as a free metal or as inorganic compounds resulting from either corrosion of process equipment or contaminants from other refining processes.

As the Conradson carbon value of the feedstock increases, coke production increases and this increased load will raise the regeneration temperature; thus any given cracking-regeneration unit may be limited as to the amount of feed that can be processed, because of its Conradson carbon content.

The metal containing fractions of reduced crudes contain Ni-V-Fe-Cu in the form of porphyrins and asphaltenes. These metal containing hydrocarbons are deposited on the catalyst during processing and are cracked in the riser to deposit the metal with hydrocarbonaceous material on the catalyst. These deposits are carried by the catalyst substantially as metallo-porphyrin or asphaltene to a regeneration operation and converted to the metal oxide during regeneration. The adverse effects of the deposited metals during hydrocarbon conversion as taught in the literature are to cause non-selective or degradative cracking and dehydrogenation to produce increased amounts of deposited carbonaceous material and light gases products such as hydrogen, methane and ethane. These reaction mechanisms adversely affect the cracking selectivity, resulting in poor product yields and poor quality gasoline and light cycle oil. The increased production of light gases, while impairing the yield and selectivity of the processes, also puts an increased demand on the downstream gas plant gas compressor capacity. The increase in coke production, in addition to its negative impact on yield, also adversely affects catalyst activity-selectivity, greatly increases regenerator air demand and compressor capacity and contributes to high regenerator temperature.

Certain crudes such as Mexican Mayan or Venezuelan crudes contain abnormally high metal and Conradson carbon values. If these poor grades of crude are processed as is in a reduced crude process, they will lead to an uneconomical operation because of the high coke burning load on the regenerator and the high catalyst addition rate required to maintain catalyst activity and selectivity. The addition rate can be as high as 4–8 lbs./bbl. which at today's catalyst prices, can add as much as $2–8/bbl. as additional catalyst cost to the processing economics. It is therefore desirable to develop an economical means of processing poor grade crude oils, such as the Mexican Mayan, because of their availability and cheapness as compared to Middle East crudes.

The literature suggests many processes for the reduction of metals content and Conradson carbon values of residual oil, topped or reduced crudes and other contaminated high boiling oil fractions. One such process is that described in U.S. Pat. No. 4,243,514 and German Pat. No. 29 04 230 assigned to Engelhard Minerals and Chemicals, Inc., which patent disclosures are incorporated herein by reference thereto. These prior art processes involve contacting a reduced crude fraction or other contaminated oil fraction with a sorbent material at elevated temperatures in a sorbing zone, such as in a fluid bed contact zone to produce a product of reduced metal and Conradson carbon value. One of the sorbents described in U.S. Pat. No. 4,243,514 is an inert solid initially composed of kaolin, which has been spray dried to yield microspherical particles having a surface area below 100 $m^2/g$ and a catalytic cracking micro-activity (MAT) value of less than 20 which is calcined at high temperature so as to achieve better attrition resistance.

DISCLOSURE OF THE INVENTION

The invention is directed to a method of producing a higher grade of residual oil or a reduced crude feedstock having lowered metals and Conradson carbon values from a poor grade of crude oil or other carbo-metallic containing oil portion thereof having undesirable high metals and Conradson carbon values.

The method or process of the invention may also be used for processing crude oils or crude oil fractions comprising significant levels of metals and/or Conradson carbon values to provide an improved feedstock suitable for use in a more conventional fluid catalytic (FCC) cracking process.

More particularly, the invention is concerned with the use of an improved sorbent material which will reduce the catalyst deactivation components in the higher boiling portions of crude oils, reduce the temperatures encountered in a sorbent regeneration zone, and reduce the deactivation effects during burning hydrocarbonaceous deposits including the high Conradson carbon contaminants deposited from poor quality feeds. The invention is particularly useful in the production of relatively low metals and Conradson carbon containing feeds suitable for use in a (RCC) reduced crude cracking process.

An important feature of the present invention is directed to the inclusion of a select group of metal additives, their oxides or salts, or an organo-metallic compound thereof into the sorbent material which will promote the endothermic reaction of $CO_2$ with hydrogen to produce CO and water and $CO_2$ with carbon to produce CO. Thus a $CO_2$ rich gas or oxygen modified $CO_2$ rich gas recovered, for example, from a CO boiler or any other available source may be employed to some considerable advantage in regenerating a sorbent material comprising high levels of deposited carbonaceous material in accordance with this invention.

It has long been known that reduced crudes with high Conradson carbon producing values present serious processing problems as to sorbent and catalyst deactivation as well as unit metallurgy problems at elevated regenerator temperatures above 1400° F. and in the presence of steam generated during burning of hydrogen containing carbonaceous material. The rapid loss of sorbent capacity and catalyst activity during hydrocarbon conversion manifests itself in a loss of pore structure. The loss of sorbent pore structure is due to sintering and becomes more rapid and severe with increased temperatures due to increased Conradson carbon deposits on the sorbent. Prior to the present invention, it was believed impractical to operate economically at Conradson carbon values higher than 8 wt% because of this phenomenum. Previously, sorbent deactivation at high levels of coke deposition has been retarded by lowering regenerator temperatures via longer burn times, large sorbent inventory or a high residual carbon was retained on the regenerated sorbent. These solutions do not necessarily solve the problem because longer burn times or large sorbent inventories still can lead to sorbent deactivation. The long stew or soaking contact time of the sorbent during burning carbonaceous material in the regenerator and a high residual carbon on regenerated sorbent yield a sorbent of lower sorbent capacity which requires a higher sorbent to oil ratio and ultimately more coke being charged to the regenerator.

Some crude oils and some residual oil charge stocks obtained from the distillation of crude oils contain significant amounts (greater than 0.1 ppm) of heavy metals such as Ni, V, Fe, Cu, Na and Conradson carbon values of 0.5 wt% or greater. Some other residual oil fractions obtained from crude oil and comprising a resid portion thereof have even greater amounts of the heavy metals, asphaltenes and also have high Conradson carbon values. According to the present invention, these residual oil fractions or reduced crudes are converted to more desirable lower boiling processable feeds suitable for use in a reduced crude cracking (RCC) unit by contact thereof with an improved sorbent particle material comprising one or more of a select group of metal additives which will particularly catalyze the endothermic removal of carbonaceous deposits and/or coke deposited on the sorbent material.

As the Conradson carbon value of a residual oil or a reduced crude comprising carbo-metallic feed components increases past 8 wt%, the coke load charged to the regenerator in the form of hydrocarbonaceous material and residual coke when clean burned is great enough to raise regenerator temperatures above 1400° F., and more usually increase temperatures up to 1600° F. or more at the higher Conradson carbon values. The two main reactions encountered in the combustion of hydrocarbonaceous deposits on a spent sorbent material are the conversion of carbon to carbon oxides and hydrogen to water. The carbonaceous material comprising hydrogen deposited on a sorbent material consist of approximately 95 wt% carbon and approximately 5 wt% hydrogen. By employing regeneration schemes and techniques of this invention, a portion of the carbon and hydrogen can be combusted or converted to their oxides under exothermic conditions and a portion of the carbon under endothermic conditions. Therefore, the regenerator temperatures can be more effectively controlled below 1600° F. and preferably below 1500° F. so as to considerably reduce or lower permanent deactivation of the sorbent and secondly, feedstocks possessing higher Conradson carbon values, up to approximately 24 wt%, can be processed without undesired and excessive damage to the sorbent particle material.

It has been reported that the reaction of carbon with carbon dioxide to yield carbon monoxide is feasible at elevated temperatures and pressures, which temperatures and pressures are beyond the normal operating limits of a solid particle regeneration operation in association with a hydrocarbon feed decarbonizing unit. The addition of select metal additives in accordance with this invention increases the rate of conversion of carbon with carbon dioxide to yield carbon monoxide at much lower temperatures in the range of about 1350° F. to about 1500° F., which is within more acceptable operating limits of a decarbonizing sorbent regeneration unit. The select group of metal additives identified by this invention, catalyze the endothermic reaction of carbon dioxide with carbon to yield carbon monoxide which product can be converted and utilized in a downstream CO boiler to form $CO_2$. This promoted endothermic reaction, will thus lower the heat released in a regenerator over that normally obtained by the combustion of carbon with an oxygen containing gas to form carbon oxides.

The desirability for promoting the endothermic reaction of carbon with carbon dioxide to form carbon monoxide is that the reaction releases only 40% of the heat normally released by combusting carbon monoxide with oxygen to carbon dioxide. Secondly, the conversion of hydrogen present in the hydrocarbonaceous deposit to form water through combustion with an oxygen containing gas is a more highly exothermic reaction than that obtained by oxygen combustion of carbon to form carbon oxides. It was further discovered that carbon dioxide will react with the hydrogen present in carbonaceous material such as deposited on a solid sorbent material during carbo-metallic heavy oil decarbonizing processing to yield water and carbon monoxide. This reaction is slightly exothermic but nowhere near the exothermicity exhibited by the oxidation of hydrogen with an oxygen containing gas.

The select group of metal additives identified by this invention were chosen to particularly catalyze the endothermic removal of carbonaceous material from a solid sorbent material after treatment of a residual oil comprising carbo-metallic heavy oil components. The additive metals herein identified catalyze the reaction of coke and hydrogen with carbon dioxide to yield carbon monoxide and water at a rate sufficient to remove approximately 40 wt% or greater of the carbonaceous material as an endothermic reaction. This method of carbonaceous material removal permits operation of a solid sorbent material regenerator for example at lower temperature limits below 1500° F. that do not lead to excessive sorbent temperature deactivation and more importantly, one can thereby more effectively process high boiling reduced crudes, topped crudes and carbo-metallic containing oils with Conradson carbon values up to about 24 wt% or more.

The method of addition of one or more of the select metal additives can be achieved during sorbent manufacture or at any point in a reduced crude decarbonizing processing cycle. Addition of the metal additive during manufacture of solid sorbent particles may be made either to the sorbent slurry before particle formation or by impregnation after sorbent particle formation, such as after spray drying of the sorbent slurry to form microspheres. It is to be further understood, that the sorbent particles can be of any size, depending on the size appropriate for the solids decarbonizing process in which the sorbent is to be employed. Thus, while a fluidizable particle size is generally preferred, the metal additives may be employed with larger size sorbent particles, such as those of at least 1/16" diameter and suitable for a moving sorbent bed system during contact with partially vaporized or unvaporized heavy resid comprising feed materials.

Problems caused by oil feeds comprising high Conradson carbon containing contaminants deposited on a sorbent material and/or a cracking catalyst are overcome in substantial measure by employing a sorbent material with a select group of metal additive as provided by this invention. Although feed preparation for FCC operations are also contemplated, this invention is especially concerned with the preparation and processing of heavy feeds comprising residual oils boiling above atmospheric tower bottoms such as reduced crudes and other carbo-metallic containing high boiling oil feeds which do not vaporize up to 1025° F. and comprising high metals, high vanadium to nickel ratios and high Conradson carbon values. Thus a high boiling oil having high concentration of metal contaminants and Conradson carbon producing components or values is preferably contacted in a riser contact zone with a fluidizable sorbent particle material of low surface area at temperatures above about 900° F. but below about 1200° F. The residence time of the high boiling oil feed in contact with solid sorbent in the riser is below 5 seconds, and preferably in the range of 0.5 to about 2 seconds or 3 seconds. The sorbent material employed in one specific embodiment is a spray dried solid particle composition in the form of microspherical particles generally in the size range of 10 to 200 microns, more usually in the range of 20 to 150 microns and preferably between 20 and 80 microns, to ensure adequate solids fluidization properties.

The heavy oil feed to be decarbonized and demetallized is introduced to a lower portion of a riser contact zone in contact with sorbent particle material at a temperature in the range of about 1150° to about 1400° F. to form a suspension and provide a temperature at the exit of the decarbonizing riser in the range of about 900° F. to about 1100° F. The high boiling feed may be charged to the riser in combination with one or more diluent components such as water, steam, naphtha, noncombustion supporting flue gas, or other suitable vapors or gases to aid with vaporization-atomization of the high boiling oil feed and aid as a lift gasiform medium to control residence time of vaporized oil material in the riser within a desired range. On the other hand, a suspension of sorbent particle material in lift gas may be initially formed in a bottom portion of the riser before adding the high boiling oil feed with suitable atomizing diluent thereto to be demetallized and decarbonized.

Sorbent material comprising carbonaceous deposits is rapidly separated from hydrocarbon vapors at the exit of the riser contact zone by employing any of the techniques known in the art or by employing the vented riser concept described in U.S. Pat. Nos. 4,066,533 and 4,070,159 to Myers et al, which patents are incorporated herein by reference thereto. During the course of the decarbonizing-demetallizing operation with sorbent material in the riser, substantial portions of metal contaminants and Conradson carbon producing compounds are deposited on the sorbent material. After separation of sorbent material from the gasiform or vaporous products at the riser outlet, the sorbent comprising hydrocarbonaceous deposits is collected as a relatively dense fluidized bed of sorbent in a lower portion of a disengagement vessel contiguous with a stripping zone. The disengagement vessel may be about the upper end of the riser contact zone. The collected sorbent material is transferred to a stripper zone for removal of any vaporized hydrocarbons before passage to a sorbent regeneration zone. The sorbent particle material with metal and carbonaceous deposits comprising hydrogen is contacted in a sorbent regeneration operation with an oxygen containing gas and a carbon dioxide rich gas to remove the hydrocarbonaceous material through the reaction combination herein described comprising combustion to form carbon oxides and reaction of $CO_2$ with carbon and hydrogen to form CO and steam. A regenerated sorbent material is obtained containing less than 0.2 wt% residual carbon, preferably less than 0.1 wt% residual carbon. The regenerated sorbent material thus obtained is then recycled to the riser contact zone where the high temperature sorbent material is brought in contact with additional high metal and Conradson carbon containing feed to repeat the cycle.

This invention is directed to a new approach to offsetting the adverse effects of high temperataure regeneration of solids comprisng high Conradson carbon residues of reduced crude processing by the incorporation of one or more of a select group of metals, their oxides or their salts into the sorbent matrix material either during sorbent manufacture, by addition to the undried sorbent composition, by impregnation techniques after spray drying, during other particle forming steps, or by introducing the select metal additive at one or more points in the circulating sorbent contacting system.

The metal additives found suitable for catalyzing the endothermic removal of hydrocarbonaceous material comprising carbon and hydrogen deposited on sorbent materials as herein identified includes one or more of the following metals, their oxides and salts, or the organo-metallic compounds of: Li, Na, K, Sr, V, Ta, Mo, Re, Fe, Co, Ni, Ru, Rh, Pd, Os, Ir, Pt, Cu, Ag, Au, Sn, and Bi. These metal additives based on the metal element content may be used in concentration in the range of from about 0.1 wt% (1000 ppm) to about 10 wt% (100,000 ppm), and preferably in the range of about 0.5 wt% (5,000 ppm) to about 5 percent (50,000 ppm) by weight of virgin sorbent. More particularly, when employing a sorbent regeneration temperature of about 1400° F., the additive metal is preferably at least about 1 wt% (10,000 ppm). On the other hand, when employing a temperature of about 1600° F., at least about 0.5 wt% (5000 ppm) of the additive metal may be employed. However, these recited concentrations will vary with particular metal additive employed in view of the coke removal rate for the various elements identified in Table A, B and C below. If the metal or its compound is added during the decarbonizing-demetallizing operation, the selected metal additive may be built up to any desired concentration on the equilibrium sorbent material and be maintained at the desired predetermined equilibrium level by sorbent replacement.

The sorbent material employed in the process of this invention include solids of low catalytic activity, such as catalytically spent catalyst, clays such as, bentonite, kaolin, montmorillonite, smectites, and other 2-layered lamellar silicates, mullite, pumice, silica, laterite, and combinations of one or more of these or like materials. The surface area of these sorbents are preferably below 25 $m^2/g$, have a pore volume of at least 0.2 cc/g or at least 0.4 cc/g and a micro-activity value as measured by the ASTM Test Method No. D3907-80 of below 20.

BRIEF DESCRIPTIONS OF THE DRAWINGS

DISCUSSION OF SPECIFIC EMBODIMENTS

Figure 1:
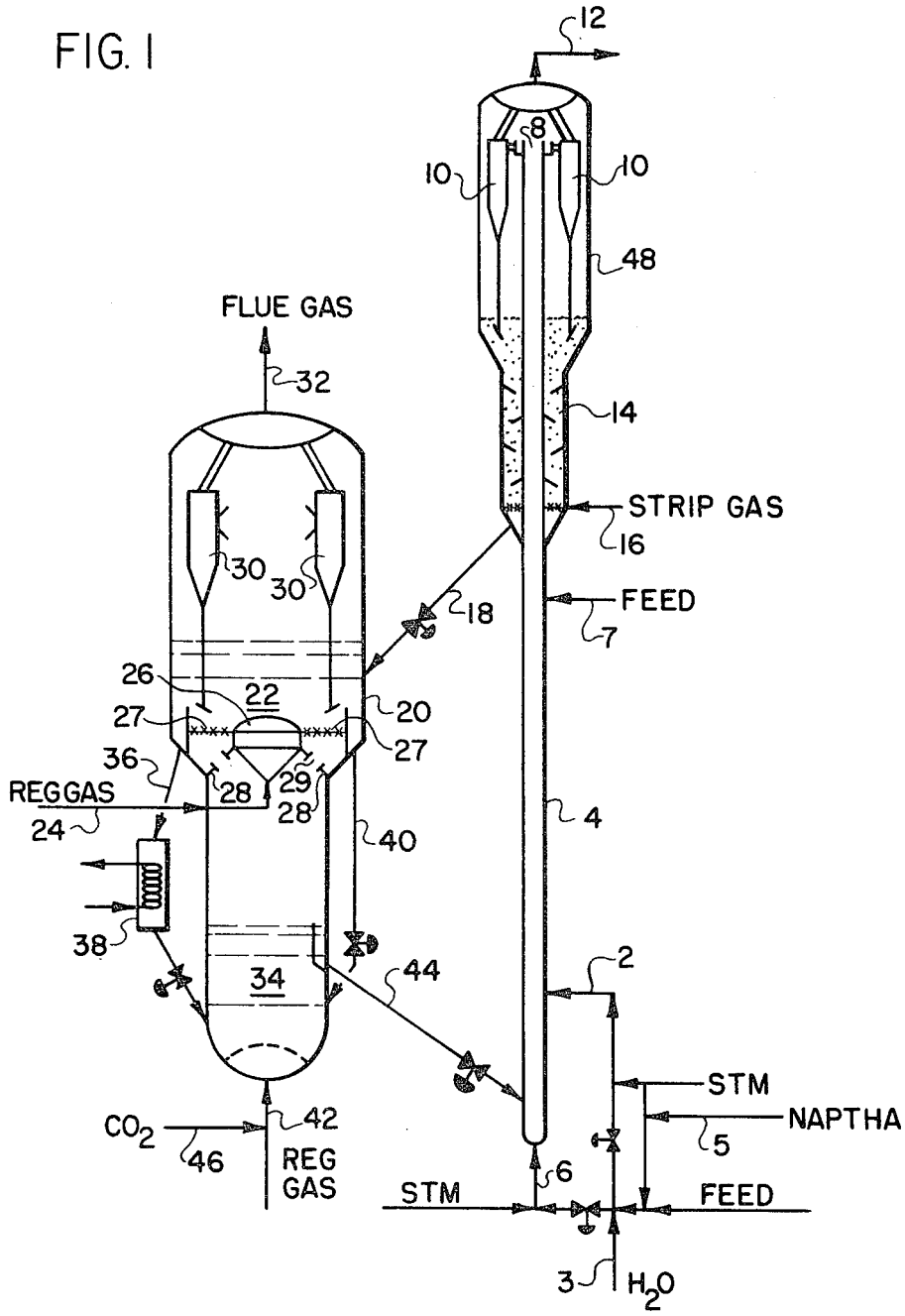
FIG. 1 is a schematic diagram of an arrangement of apparatus for carrying out the process of the invention.

It is not proposed to particularly define the exact mechanism for the reaction of carbon with carbon dioxide to yield carbon monoxide in the presence of certain metal additives and concentrations except to say it has been found to occur. It has been found further, that a preferred amount of the select metal additive added to the sorbent will be in the range of about 0.2 to 5 wt%. In the presence of carbon dioxide the metal additive will catalyze the endothermic removal of coke to form carbon monoxide. The activity of a select group of additive metals was tested towards catalyzing the reaction of coke with carbon dioxide at 1400° F. employing a 20 minutes reaction time to measure the rate of coke removal. Based on this specific temperature-time element parameter, one can identify many examples of metal additives that will promote from 40 to 70% removal of coke through the carbon-carbon dioxide reaction mechanism. This permits a determination of the best, intermediate and poor metal additives for the purpose under conditions expected to be experienced in decarbonizing sorbent regenerator.

EXAMPLES OF ADDITIVES

The select group of additive metals of this invention fall into several groupings and are shown in the following Tables A, B, and C. They include the elements from the Periodic Chart of Elements. The rate of removal of coke deposited on a sorbent material during carbo-metallic processing is shown.

TABLE A

HIGHEST ACTIVITY
Additive metal - 1 wt %; 1400° F.
Process time - 20 minutes; Coke on Sorbent - 1.1 wt % C

| | | Coke Removal Rate % |
|---|---|---|
| Group IA | Li, Na | 60 |
| Group IIA | Sr | 45 |
| Group VIIB | Re | 50 |
| Group VIII | Fe, Co, Ni, Ru, Rh, Pd, Os, Ir, Pt | 50 |
| Group IB | Cu, Ag, Au | 45 |

TABLE B

INTERMEDIATE ACTIVITY
CONDITIONS: Same as Table A

| | | Coke Removal Rate % |
|---|---|---|
| Group IVA | Sn | 30 |
| Group VA | Bi | 30 |
| Group VB | V | 35 |
| Group VIB | Mo | 30 |

TABLE C

| | | Coke Removal Rate % |
|---|---|---|
| Group IA | K, Rb, Cs | 20 |
| Group IIA | Mg, Ca, Ba | 20 |
| Group IIIB | Sc, Y, La | 20 |
| Group IVB | Ti, Zr, Hf | 25 |
| Group VIB | Cr, W | 25 |
| Group VIIB | Mn | 20 |
| Group IIB | Zn, Cd, Hg | 20 |
| Group IIIA | B, Ga, In | 20 |
| Group VA | As, Sb | 10 |
| Group VIA | Se, Te | 10 |
| Actinide Series | | 25 |
| Lanthanide Series | | 20 |

Table A lists the elements that gave coke removal rates between 45–60%, Table B lists the elements that gave 30–35% and Table C lists the remainder of the elements that gave coke removal rates below 30% (20–25%). This invention recognizes that the rates of removal of the elements in Table B and C can be improved by increasing severity, such as contact time, temperature, additive metal concentration, pressure and the like.

The highest activity metal additive for catalyzing the endothermic coke removal rate of at least 45% are listed in Table A and those of intermediate activity rate of 30 or greater are listed in Table B. This invention recognizes that these metal additives can be utilized as a single metal additive or a combination of metal additives from each group or a combination of the groups such as A+B, etc. The mixture or combination of select metal additives can be added during manufacture, after manufacture or after spray drying by impregnation techniques, at any point in the sorbent cycle during oil processing or the metal can be deposited on the sorbent from the carbo-metallic containing oil feed as naturally occurring metal contaminants in the oil feed, such as nickel and vanadium found in porphyrins and asphaltenes.

This invention also recognizes that the addition of the metals may have an effect on any acid cracking activity of the clay sorbent, such as a neutralization of any acidic cracking sites to yield a substantially inert amorphous material. Thus, based on the criteria of acid site neutralization, metal cost and reaction rate, the preferred single and combination of metal additives of the invention to catalyze the endothermic removal of coke with $CO_2$ from sorbent materials would include the elements from Tables A-B. The preferred metal additives deposited from a reduced crude, topped crude or crude oil would include Fe, Ni, V and Cu.

This invention further recognizes that in addition to the binary mixtures discussed above, ternary and even quarternary reaction mixtures can occur between metal additives of the highest and intermediate activity with metal additives of the low activity group and metals not covered in the Groups above. Examples of some binary and ternary compounds are shown in Table D.

TABLE D

| | Coke Removal Rate % |
|---|---|
| $Ba_3V\ Ti_2O_9$ | 30 |
| $Sr_3TiO_3$ | 30 |
| $CuTiO_3$ | 30 |

Where the additive is introduced directly into the decarbonizing process, that is into the riser reactor, into the regenerator or any intermediate point there between, the metal additives are added preferably as organo-metallic compounds which are soluble in the hydrocarbon feed or in a hydrocarbon solvent miscible with the high boiling feed. Examples of organo-metallic compounds would include alcoholates, esters, phenolates, naphthenates, carboxylates, dienyl sandwich compounds, and the like. The invention therefore is not limited to the specific examples identified above.

The organo-metallic additives can be introduced directly into the hydrocarbon contacting zone, such as any point along the riser, in the sorbent disengagement vessel or the stripper, so that the metal additive will be deposited on the sorbent along with the heavy metals and coke formers in the feed or after deposition of the heavy metals and coke formers. When the additive metal of the invention reaches the regenerator, its oxide is formed, either by decomposition of the additive directly to the metal oxide or by decomposition of the additive to the free metal which is then oxidized under the regenerator oxidizing conditions. This provides an intimate mixture of metal additive and coke and is believed to be one of the more effective means for contacting coke as soon as it is formed in the riser. The metal additive is introduced into the riser by mixing it with the feed or into the disengagement vessel or stripper sufficient to deposit 0.1–10 wt% metal additive on the sorbent, most preferably 0.2–5 wt% metal additive based on virgin sorbent weight.

If the metal additive is added directly to the sorbent particle during sorbent manufacture or at some other time before the sorbent is introduced into the conversion system, the metal additives are preferably water soluble inorganic salts of these metals, such as acetate, halide, nitrate, sulfate, sulfite and/or carbonate. These additive compounds are soluble in a sorbent slurry or in a water impregnating solution. If the metal additive is not added to the sorbent before or during particle formation, then it can be added by impregnation techniques to the dried sorbent particles, which are preferably spray dried microspheres. Impregnation after drying may be advantageous in some cases where sites of additive metal are likely to be impaired by sorbent matrix material which might partially cover additive metal sites introduced before spray drying or before some other particle solidification process. Inorganic metal additives may also be introduced into the conversion process along with a water containing streams, such as might be used to cool the solids in the regenerator by direct injection thereto or to lift, fluidize or strip sorbent.

Another series of active metal additives are the binary, ternary and quarternary type compounds comprising vanadium immobilization additives described in International Application No. PCT-US81-00357 entitled, "Immobilization of Vanadia Deposited on Catalytic Materials During Carbo-Metallic Oil Conversion" filed on Mar. 19, 1981 and International Application No. PCT-US81-00356 entitled, "Immobilization of Vanadia Deposited on Sorbent Materials During Carbo-Metallic Oil Conversion" filed on Mar. 19, 1981, which patent applications are incorporated herein by reference thereto. These patent applications describe the destruction of a zeolite catalyst by vanadium and the select metal additives of the invention which will immobilize liquid vanadium through compound or complex formation, such as vanadium titanate, zirconium titanate, barium vanadium titanate, calcium vanadium titanite, manganese vanadate and the like. This invention recognizes the broad range of binary, ternary and quarternary compounds or complexes that can be formed between the metal additives of this invention and the vanadia immobilization additives.

EXAMPLE OF SPRAY DRYING TO PRODUCE SORBENT

A specific example of a sorbent material which may be prepared for use in the method according to the invention, is well-known to specialists in the field. It is used as a chemical reaction component with sodium hydroxide for the production of fluidizable zeolite-type cracking catalysts, as described in U.S. Pat. No. 3,647,718 to Haden et al. This sorbent material is a dehydrated kaolin clay. According to analysis, this kaolin clay contains about 51 to 53% (wt%) $SiO_2$, 41 to 45% $Al_2O_3$ and 0 to 1% $H_2O$, the remainder consisting of small amounts of originally present impurities. Although these impurities may include titanium, this titanium is bound up in the clay and is not in a form capable of tying up a significant amounts of vanadium.

In order to facilitate the spray drying, this powdered dehydrated clay is dispersed in water with or without the presence of a deflocculation agent, for example, sodium silicate or a condensed phosphate sodium salt, such as tetrasodium pyrophosphate. By employing a deflocculation agent the spray drying can be conducted with a higher proportions of solids in the slurry which generally leads to harder product. By using a deflocculation agent, it is possible to produce suspensions which contain from about 55 to about 60% solids. These suspensions of high solids content are considered better than suspensions comprising a solids content of about 40 to about 50% and obtained without the use of a deflocculation agent.

Several different procedures can be used to mix the ingredients for the production of a suspension. For example, in one procedure the finely divided solids are mixed dry, then water is added, and after that the deflocculation agent is worked in. The components can be processed mechanically, either together or individually, in order to produce suspensions with the desired viscosity properties.

If a cocurrent spray dryer is used, the air inlet temperature can be as high as 649° C. (1200° F.) and the clay suspension should be charged at a rate sufficient to guarantee an air outlet temperature of about 121° to 316° C. (250° to 600° F.). At these temperatures the free moisture of the suspension is driven away without removing the water of hydration (water of crystallization) from the crude clay component. A dehydration of part or all of the crude clay during the spray drying is also contemplated. The product from the spray dryer can be fractioned or separated in order to obtain microspheres of the desired particle size. The microspherical particles intended to be used in the present invention have diameters in the range of about 20 to 100 microns and preferably from about 20 to about 80 microns. Calcination of the spray dried particles can be conducted if desired by introducing the spray-dried particles directly into a calcining apparatus.

EXAMPLES OF ADDITIVES IN SORBENT

In one embodiment of the invention, the metal additive is incorporated directly into the sorbent material. To an aqueous slurry of the raw sorbent material is mixed the metal additive in an amount to yield approximately 1.0 to 10 wt% concentration thereof or from 0.2 to about 5 wt% concentration on the finished sorbent. These metal additives can be added in the form of a water soluble compound such as nitrate, halide, sulfate, carbonate, or the like. This mixture may then be spray dried to yield the finished sorbent as a microspherical particle of a size in the range of 10 to 200 microns with the active metal additive deposited within the matrix and/or on the outer surface of the sorbent particle.

After mixing the sorbent material with metal additive, the composition is slurried and spray dried to form sorbent particle microspheres of desired size less than 200 microns.

Although it is advantageous in some cases to calcine the microspheres at temperatures in the range of about 871° to about 1150° C. (1600° to 2100° F.) in order to obtain particles of maximum hardness, it is also possible to dehydrate the microspheres by calcining at lower temperatures. Temperatures of about 538° to 871° C. (1000° to 1600° F.) can be used, to transform the clay into a material known as "metakaolin". After calcination, the microspheres should be cooled down and, if necessary, fractionated or separated to obtain the desired particle size range.

Example of Titania Containing Sorbent

| | MATERIALS | AMOUNT |
|---|---|---|
| (A) | Tap Water | 11 liters |
| (B) | $Na_2SiO_3$ - PQ Corp. 'N' Brand | 8.35 liters |
| (C) | Concen. $H_2SO_4$ | 1.15 liters |
| (D) | Alum | 0.8 kg. |
| (E) | Clay - Hydrite AF | 12 kg. |
| (F) | Titania - DuPont Anatase | 1 kg. |
| (G) | Sodium Pyrophosphate | 150 gm. |

Ingredients G, E, and F in this order are added while mixing to 8 liters of water at a pH of 2 and ambient conditions to obtain a 70 wt% solids slurry which is held for further processing.

Tap water (A) is added to a homogenizing mixer (Kady Mill) with sulfuric acid (C) and mixed for five minutes. Sodium silicate B is then added continuously over a fifteen minute period (600 ml/min.) to the stirred acid solution to provide a silica sol.

The 70 wt % solids slurry from the first step is then added to a stirred Kady Mill and mixed for fifteen minutes. The pH of the solution is maintained at 2.0–2.5 by addition of acid if needed. The temperature during addition, mixing, and acidification is maintained below 120° F. and the viscosity of the solution adjusted to 1000 (CPS) centipoise by the addition of water.

The resulting mixture is immediately atomized, i.e. sprayed, into a heated gaseous atmosphere, such as air and/or steam having an inlet temperature of 400° C., and an outlet temperature of 130° C., using a commercially available spray drier. The resulting microspherical particles are washed with about 20 liters of hot water and dried at about 350° F. for about 3 hours. This yields a sorbent containing 5 wt% titanium as titanium dioxide on a volatile free basis.

It is considered critical that the mixing and subsequent spraying take place rapidly to prevent premature setting of the gel. In this connection, the silica sol and the solids slurry may be added separately to a spray drier nozzle and the two streams mixed instantaneously and homogeneously. Such a mixing process is described in U.S. Pat. No. 4,126,579, which is incorporated herein by reference. The air atomizer used should feed the two components into the nozzle at pressures of about 30 to 90 psi and maintain the air in the nozzle at about 50 to 60 psi, preferably about 51–53 psi. As an alternative to premixing with either component, the metal additive may also be fed separately to the nozzle via a separate line operated at pressures of about 30 to 90 psi.

TITANIA IMPREGNATED SORBENT

Seventy-five grams of sorbent (not calcined) is dried at 100° C. under vacuum for two hours. 2.4 ml. of DuPont's Tyzor TPT (tetra isopropyl titanate) is dissolved in 75 ml. of cyclohexane. Utilizing a Roto-Vap apparatus, the titanium solution is added to the vacuum dried sorbent with agitation for 30 minutes. Excess solution is then stripped from the impregnated sorbent to provide a dried solid particle. The sorbent is then humidified in a dessicator (50% relative humidity) for 24 hours. The sorbent is then regenerated (organic moieties burned off) as a shallow bed of material in a furnace at 900° F. for 6 hours. This procedure yields a sorbent containing 0.53 wt% Ti on sorbent.

EXAMPLE OF COPPER IMPREGNATED SORBENT

A copper impregnated sorbent was prepared to study its ability to catalyze the endothermic removal of coke deposited on a catalytic material during carbo-metallic oil processing. A sorbent material was coked to yield 1.1 wt% carbon on catalyst by processing a reduced crude over it at 1000° F. 100 grams of this coked sorbent was impregnated with 20 grams of a water solution containing 2.12 g. of cupric chloride ($CuCl_2$). There was no excess solution to decant since this technique (impregnating volume) is the minimum volume impregnation procedure. The sorbent was dried under vacuum at 100° C. for three hours and analyzed by x-ray fluorescence to show that 1 wt% Cu was present. Since coke is present on the sorbent it could not be calcined before use. The coked-copper containing sorbent was then placed in the reaction chamber and heated to 1450° F. in an inert gas. At that time, a gas containing 100% carbon dioxide was introduced and the rate of conversion of coke with carbon dioxide to yield carbon monoxide was measured with time. The rate of coke removal was shown to be 45%, as reported in Table A.

MOVING BED SORBENT

A hydrosol containing the sorbent materials described in this invention are introduced as drops of hydrosol into a water immiscible liquid wherein the hydrosol sets to spheroidal bead-like particles of hydrogel. The larger size spheres are ordinarily within the range of about 1/64 to about ¼ inch in diameter. The resulting spherical hydrogel beads are dried at 300° F. for 6 hours and calcined for 3 hours at 1300° F. The use of these calcined spherical beads is of particular advantage in a moving bed process.

Representative feedstocks contemplated for use with the invention include whole crude oils; heavy gas oils, vacuum gas oils; and heavy fractions of crude oils such as topped crude, residual oils, reduced crude, vacuum fractionator bottoms, other fractions containing heavy residua, coal-derived oils, shale oils, waxes, untreated or deasphalted residua, and blends of such fractions with gas oils and the like.

The preferred hydrocarbon feeds to be processed according to this invention comprise 650° F.+material of which at least 5 wt%, preferably at least 10 wt%, does not boil or vaporize at a temperature below about 1025° F. The terms "high molecular weight" and/or "heavy" hydrocarbons refer to those resid hydrocarbon fractions having a normal boiling point of at least 1025° F. and include non-boiling hydrocarbons, i.e., those materials which may not boil under any conditions.

The metals-Conradson carbon removal process described in this specification is preferably employed to provide a suitable demetallized and decarbonized feedstock for use as feed in catalytic conversion processes described in co-pending U.S. applications directed to RCC or FCC operations.

A carbo-metallic containing hydrocarbon feed for purposes of this invention is one having a heavy metal content of at least about 4 ppm nickel equivalents, (ppm total metals being converted to nickel equivalents by the formula: Ni Eq.=Ni+V/4.8+Fe/7.1+Cu/1.23), a Conradson carbon residue value greater than about 1.0, and a vanadium content of at least 1.0 ppm. The feedstocks for which the invention is particularly useful will also have a heavy metal content of at least about 5 ppm of nickel equivalents, a vanadium content of at least 2.0 ppm, and a Conradson residue of at least about 6.0. The greater the heavy metal content and the greater the propostion of vanadium in that heavy metal content, the more advantageous the select metal additives processes of this invention becomes.

A particular feedstock for decarbonizing treatment by the concepts of the invention includes a residual oil or reduced crude comprising 70% or more of a material boiling in the range of 650° to 1025° F. and comprising a resid fraction greater than 20% boiling if at all above 1025° F. at atmospheric pressure, a metals content greater than 5.5 ppm nickel equivalents of which at least 5 ppm is vanadium, a vanadium to nickel atomic ratio of at least 1.0, and a Conradson carbon residue greater than about 6.0. This feed may also have a hydrogen to carbon ratio of less than about 1.8 and coke precursors in an amount sufficient to yield about 10 to 28% coke by weight based on fresh feed.

With respect to the tolerance levels of heavy metals on the sorbent itself, such metals will be accumulated on the sorbent to levels above 3000 ppm, and preferably in the range of 10,000 to 30,000 ppm, of which greater than 5% and more usually from 10 to 80% is vanadium.

The residual or high boiling feed may contain nickel in an amount so that oxides of nickel may help tie up vanadium pentoxide in a high melting complex, compound or alloy. The invention, therefore, contemplates controlling less than desired amounts of nickel in the feed by introducing a nickel additive. On the other hand, certain feedstocks with high nickel to vanadium ratios may be employed so that the compounds of nickel metal, either alone or in combination with other additives, comprise the metal additive of the invention. Similarly, a nickel containing sorbent may also be made by first using virgin sorbent, with or without another metal additive, in a treatment process employing a feedstock with a high nickel to vanadium ratio; and then using the resulting equilibrium sorbent as make-up sorbent in the process of the present invention. In these different embodiments, the atomic ratio of nickel to vanadium on the sorbent should be greater than 1.0, preferably at least about 1.5.

The treating process comprising a sorbent demetallizing-decarbonizing process of the invention will produce coke (laid as hydrocarbonaceous material) in amounts of 10 to 28 percent by weight based on weight of fresh feed . This hydrocarbonaceous material is laid down on the sorbent particles in amounts in the range of about 0.3 to 3 percent by weight of sorbent, depending upon the sorbent to oil ratio employed (weight of sorbent to weight of feedstock) in the riser contact zone. The severity of the sorbent treating process should be sufficiently low so that thermal with and without catalytic conversion of the feed to gasoline and lighter products is restricted to not exceed about 20 or 30 volume percent, and more preferably below about 20 volume percent.

The high boiling, high molecular weight component containing feed is introduced as shown in FIG. 1 into a lower portion of the riser reactor for contact with a suspension of hot sorbent particle material with or without a select metal additive as discussed above. Steam, naphtha, water, flue gas and/or other suitable or combination of diluent materials are introduced into the riser along with the high boiling hydrocarbon feed. These diluents may be from a fresh source or may be recycled from an available process stream in the refinery. Where one or more recycle diluent streams are used, they may contain hydrogen sulfide and other sulfur compounds which may passivate to some extent the catalytic activity by heavy metals accumulating on the catalyst. It is to be understood that water may be used either as a liquid or as steam. Water is preferably added to the heavy oil feed before accelerating the feed and sorbent with diluent materials. A diluent of steam with or without naphtha will aid atomized contact between feed and sorbent and achieve the vapor velocity and residence time particularly desired in the riser reactor. Therefore, the diluents serve a combination of functions including atomization, reduce the heavy oil feed partial pressure, achieve desired vapor velocity, and effect temperature control.

As the atomized-vaporized diluent containing feed travels up the riser, it thermally forms four products known in the industry as dry gas, wet gas, naphtha, and a partially decarbonized vaporized hydrocarbon feedstock. At the upper discharge end of the riser reactor, the sorbent particles are rapidly separated from hydrocarbon vapors and gasiform materials. The sorbent particles which accumulate hydrocarbonaceous deposits and metal contaminants in the riser are sent to sorbent stripping before passing to a sorbent regenerator to burn off the hydrocarbonaceous deposits. The separated hydrocarbon vapors and gasiform diluents are sent to a fractionator for further separation and recovery to provide the four products above identified. The preferred conditions for contacting feed and sorbent particles in the riser are summarized in Table D, in which the abbreviations used have the following meanings: "Temp." for temperature, "Dil." for diluent, "pp" for partial pressure, "wgt" for weight, "V" for vapor, "Res." for residence, "S/O" for sorbent to oil ratios, "sorb." for sorbent, "bbl" for barrel, "MAT" for microactivity by the MAT test using a standard Davison feedstock, "Vel." for velocity, "cge" for charge, "d" for density and "Reg." for regenerated.

TABLE E

| Sorbent Riser Conditions | | |
|---|---|---|
| Parameter | Broad Operating Range | Preferred Range |
| Feed Temp. | 300-800° F. | 300-650° F. |
| Steam Temp. | 20-500° F. | 300-400° F. |
| Reg. Sorbent Temp. | 1100-1600° F. | 1150-1500° F. |
| Riser Exit Temp. | 900-1400° F. | 900-1150° F. |
| Pressure | 0-100 psia | 10-50 psia |
| Water/Feed | 0.01-0.30 | 0.04-0.15 |
| Dil. pp/Feed pp | 0.25-3.0 | 0.1-2.5 |
| Dil. wgt/Feed wgt | ≦0.4 | 0.1-0.3 |
| V. Res. Time | 0.1-5 | 0.5-3 sec. |
| S/O, wgt. | 3-18 | 5-12 |
| Lbs. Sorb./bbl. Feed | 0.1-4.0 | 0.2-2.0 |
| Inlet Sorb. MAT | <25 vol. % | 20 |
| Outlet Sorb. MAT | <20 vol. % | 10 |
| V. Vel. | ≦25 ft./sec. | =30 |
| V. Vel./Sorb. Vel. | ≦1.0 | 1.2-2.0 |
| Dil. Cge. Vel. | 5-90 ft./sec. | 10-50 |
| Oil Cge. Vel. | 1-50 ft./sec. | 5-50 |
| Inlet Sorb. d | 1-9 lbs./ft.$^3$ | 2-6 |
| Outlet Sorb. d | 1-6 lbs./ft.$^3$ | 1-3 |

In treating carbo-metallic oil containing feedstocks, the regenerating gas may be substantially any gas which can provide oxygen to convert carbon to carbon oxides. Air is highly suitable for the exothermic combustion of hydrocarbonaceous deposits and carbon dioxide for the endothermic removal of coke in view of their ready availability. The amount of air required per pound of coke for combustion and the amount of carbon dioxide per pound of coke for endothermic coke removal depends upon the Conradson carbon content of the feedstock and retained residual coke level on the sorbent; the maintained ratio of the exothermic to endothermic reactions in the regenerator to maintain the catalyst temperature below 1600° F., preferably between 1250° and 1500° F., and upon the amount of other materials present in the carbonaceous material, such as hydrogen sulfide, nitrogen and other elements capable of forming gaseous oxides at regenerator conditions.

The regenerator is desirably maintained at a temperature in the range of about 1250° F. to 1600° F., preferably below about 1450° F., to achieve adequate carbonaceous material and carbon removal while keeping the sorbent particle temperatures below that at which a significant sorbent degradation can occur. In order to control these temperatures, it is necessary to control the rate of oxygen burning which in turn can be controlled at least in part by the relative amounts of oxidizing gas, carbon dioxide, carbon and hydrogen introduced into the regeneration zone per unit time.

The regenerator exothermic and endothermic coke removal reaction temperature is maintained so that the amount of carbon remaining on regenerated sorbent is no more than about 0.5, preferably less than about 0.2 percent and most usually less than about 0.1 percent on a substantially moisture-free weight basis.

The carbon dioxide added to the regenerator can come from any one of several sources. The flue gas recovered from a FCC or a RCC regenerator or a CO boiler of suitable $CO_2$ concentration can be added to the regenerator to remove carbon. The $CO_2$ rich gases may be obtained from a CO boiler. In addition, pure carbon dioxide from outside sources can also be employed. The flue gas from a process employing the additive metals herein identified and employing the decarbonizing method of the invention can be processed through a CO boiler to particularly increase the carbon dioxide content of the flue gas for recycle back to the regenerator for further conversion of carbon and hydrogen components on the sorbent.

The sorbent of this invention with or without the metal additive is charged to demetallizing-decarbonizing treatment unit of the type represented by FIG. 1. Referring now to FIG. 1 by way of example, sorbent particle circulation and operating parameters are brought up to process conditions by methods well-known to those skilled in the art. An equilibrium or fresh sorbent particle material at a temperature in the range of about 1400° F. to about 1500° F. contacts the heavy oil feed mixed with diluent in a lower portion of riser 4. The feed admixed with water and steam and/or flue gas may be injected by conduit 2 or conduit 6. Steam, water and/or naphtha may be injected by conduit 6 above to aid in one or both of feed vaporization-atomization, sorbent fluidization and for controlling formed suspension velocity and contact time in riser 4. The sorbent admixed with vaporous and liquid hydrocarbon droplets travel as a suspension upwardly through riser 4 for a contact time in the range of 0.5-2 seconds. The suspension of particle sorbent and vaporous hydrocarbons are separated at the riser outlet 8 at a final reaction temperature in the range of about 950° F. to about 1100° F. The vaporous hydrocarbons are transferred to multi-stage cyclones 10 where any entrained sorbent fines are separated and the hydrocarbon vapors are sent to a fractionator (not shown) via transfer line 12. The sorbent particle material comprising hydrocarbonaceous material and metal contaminants is then transferred to stripper 14 for removal of entrained hydrocarbon vapors with stripping gas charged by conduit 16 and then to regenerator vessel 20 by conduit 18 to form a dense fluidized bed 22. The sorbent with metal and hydrocarbonaceous deposits in fluid bed 22 is contacted with a mixture of flue gases from regenerator vessel 26 comprising $CO_2$ and CO admixed with oxygen containing gas admitted separately by conduit 24 and dispersion means 26. Gaseous products of regeneration from the lower bed comprising CO, $CO_2$ and steam pass upwardly through baffle or a dispersion grating 28 into bed 22 wherein hydrocarbonaceous material is converted with oxygen sufficient to raise the particle temperature in the range of 1350° to 1500° F. Whereby hydrogen is converted to steam and carbonaceous material to a CO rich flue gas, the resulting flue gas is processed through one or more cyclones 30 wherein entrained particle fines are removed before the flue gas exits from regenerator via conduit 32 and passage to a CO boiler (not shown) to convert carbon monoxide to carbon dioxide. Carbon dioxide recovered from the CO boiler may be passed to the regenerator section for use as herein defined. The exothermic regeneration of sorbent material in dense fluid bed 22 is effected to raise the temperature thereof to preferably at least about 1400° F. in regenerator vessel 20. Thereafter, the partially regenerated sorbent is transferred to a lower regenerator zone comprising dense fluid particle bed 34 via external tranfer conduit 36. Transfer conduit 36 may be an internal transfer conduit or standpipe extending down from bed 22. In the specific arrangement of the drawing, conduit 36 comprises a heat exchanger 38 which may be used as a heater if desired. Standpipe 40 is also provided for passing hot particle sorbent material from bed 22 directly to bed 34 for maintaining desired endothermic temperature control as required in bed 34. The partially regenerated sorbent comprising residual carbon and hydrogen is charged to dense fluid bed 34 wherein it is contacted with carbon dioxide to effect the endothermic removal of carbon. The $CO_2$ rich gas also reacts with residual hydrogen to form CO and steam. Carbon dioxide is admitted in heated condition via conduit 42 for this purpose. A regenerated sorbent particle material of low residual carbon at a temperature in the range of 1300° to about 1400° F. is recovered from bed 34 and transferred to the lower portion of riser 4 by standpipe or transfer conduit 44. The regenerated sorbent may be stripped in an internal or external stripping zone (not shown) to remove any entrained CO combustion supporting gases and thereafter transferred to riser 4 via conduit 44 to repeat the cycle. The temperature balance maintained in the exothermic and endothermic regeneration operations above described and product yield of water, carbon monoxide and sorbent of low residual coke is a balance of the combination comprising; rate of transfer of spent sorbent with hydrocarbonaceous deposits to regenerator vessel 20 by conduit 18, transfer of partially regenerated sorbent by conduits 36 and 40 from bed 22 to bed 34 for endothermic removal of residual carbon, the transfer of regenerated sorbent from bed 34 to riser 4 by transfer conduit 44, the rates of addition of $CO_2$ to the regenerator by conduit 42, and the rates of addition of an oxygen containing gas such as air by conduit 24 and dispersion means 26. The combination unit of FIG. 1 is considered to be in acceptable thermal balance when the sorbent regenerator temperature is maintained below 1500° F. and the temperature of the regenerated sorbent introduced to riser 4 for admixture with feed is sufficiently elevated to maintain temperature of the sorbent-vaporized-hydrocarbon-diluent suspension exiting riser 6 into disengagement vessel 48 in a temperature range of about 950° to about 1100° F.

In yet another embodiment, the regeneration operation may be completed by the combination of effecting removal of a portion of the hydrocarbonaceous material in the upper bed 22 with $CO_2$ rich gas and completing the regeneration of the sorbent material in the lower bed 34 with an oxygen containing regeneration gas. In this operating arrangement hot flue gas of the oxygen regeneration comprising CO, $CO_2$, steam and unreacted oxygen will enter the bottom portion of bed 22, supply heat thereto and unreacted oxygen will be consumed therein. It is further contemplated adding additional oxygen containing gas to the gases entering the bottom portion of bed 22 and consumption therein.

The regeneration operations of this invention are a significant departure from known prior art regeneration operations that may be accomplished in many different arrangements of contact zones comprising riser contact zones, dense fluid particle bed contact zones and combinations thereof. In one arrangement, two fluid masses of sorbent particle material separated by a common baffle means may be retained in the lower portion of a regeneration zone in which combination an upflow of particles on one side of the baffle with downflow of particles on the other side of the baffle may be relied upon to effect the exothermic regeneration step on one side and the endothermic reaction on the other side of the baffle. Since the flue gas products of each stage of regeneration are compatible they may be combined in a common dispersed phase if particles above each mass of sorbent particles before recovery and removal from the regeneration zone. Other arrangements comprising riser regenerators above or in combination with dense fluid particle bed regenerators may be used.

At such time that the metal level on the sorbent particle becomes intolerably high such that sorbent demetallizing and decarbonizing capacity and/or selectivity declines, additional fresh sorbent material can be added and deactivated sorbent withdrawn at any one of a number different points considered convenient. In the case of a virgin sorbent material without additive metal, the metal additive as an aqueous solution or as an organo-metallic compound in aqueous or hydrocarbon solvents can be added with the heavy oil feed, to the stripper 14, to conduit 18 or separately to bed 22. The addition of the metal additive is not limited to these locations, but can be introduced at any point in the processing cycle of FIG. 1. It is thus to be understood that the regeneration arrangement and sequence of FIG. 1 may be replaced by a side by side arrangement of fluid catalyst beds separated by a common baffle means to permit the regeneration sequence above discussed or other arrangements which permit accomplishing the exothermic-endothermic regeneration operation of this invention.

DEVELOPMENT AND USE OF ADDITIVE IN PROCESS

In a typical vacuum gas oil (VGO) operation, the feedstock contains relatively low Conradson carbon values in the range of 0.1–0.2 wt%. This provides relatively low carbon on catalyst values which result in regenerator temperature generally in the range of 1150° to about 1300° F. In order to increase conversion per pass or throughput or both, this can be accomplished by increasing catalyst to oil (C/O) ratios, addition of oxidation promoters to convert CO to $CO_2$ or addition of more refractory feedstocks to the gas oil such as heavy cycle oil. Slurry oil or reduced crude. In contrast, the processing of reduced crude can lead to high levels of carbonaceous deposits and thus to excessive regenerator temperatures unless steps are taken to control such conditions. Reduced crude or topped crudes are taken to control such conditions. Reduced crude or topped crudes and similar materials contain high amounts of Conradson carbon contributing materials, from as low as 2 wt% to as high as 20 wt%, and certain particular materials such as tar sands or Venezuelan Orinaco asphaltic material can be greater than 20 wt% Conradson carbon. In a reduced crude cracking (RCC) process the amount of Conradson carbon producing components in the feedstock determines the amount of carbonaceous material (coke) deposited on the catalyst. As shown previously, this is approximately equal to 4 wt% plus the Conradson carbon value of the hydrocarbon feed. As the Conradson carbon value increases and the coke on spent sorbent increases, the regenerator temperature increases. The upper limit on regenerator temperature is generally below 1600° F. and preferably the upper temperature limit is within the range of 1350° to 1500° F. This upper limit restriction is related particularly to sorbent deactivation and unit equipment metallurgy considerations. The sorbent deterioration is due in substantial measure to the composition of the hydrocarbonaceous material deposited on the sorbent, which is approximately 95%C and 5%H and comprising sulfur, nitrogen and metal contaminants. The combustion of hydrocarbonaceous material in the presence of an oxygen containing gas leads to the formation of carbon oxides and a high partial pressure of steam at high temperature so that known present day sorbents are subjected to a rapid deactivation rate in the presence of steam at temperatures above about 1450° F.

The types of feedstocks suitable as related to their Conradson carbon content is limited for present day known reduced crude conversion processes. The upper limit for the Conradson carbon content of the feed has been set for example at about 8 wt% and this is based on employing all known available processing schemes to date. One method contemplated employs the addition of water to cool the hot regenerated catalyst and regeneration gases. Another method contemplated is directed to controlling the $CO_2/CO$ ratio of the exiting regenerator flue gas. The combustion of carbon to CO generates only 40% of the heat that generated by combusting CO to $CO_2$.

Figure 2:
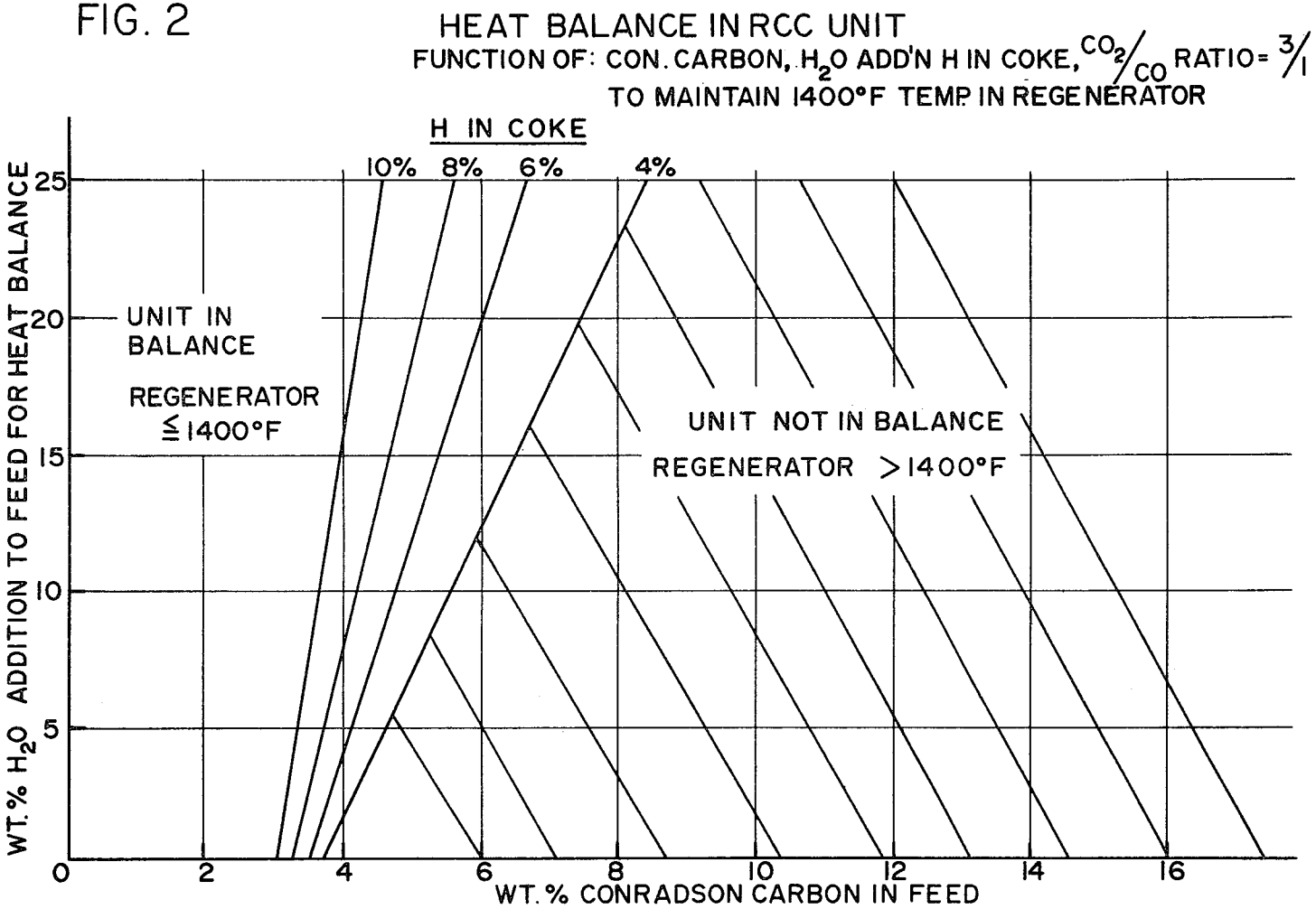
FIG. 2 is a graph showing heat balance attained in a RCC unit as a function of Conradson carbon in the feed, water addition, and changing hydrogen content in the coke at a flue gas content of $CO_2/CO=3/1$.
Figure 3:
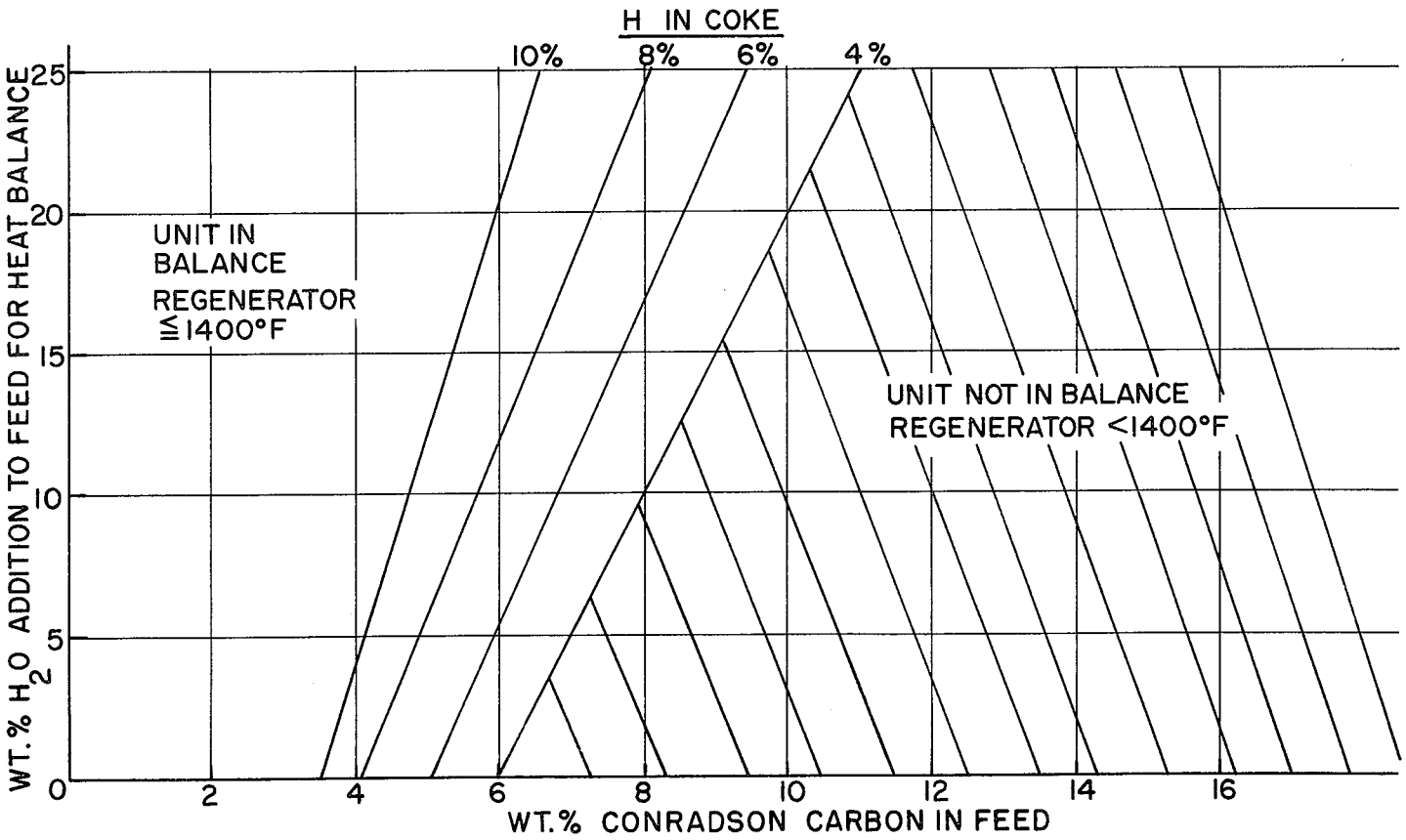
FIG. 3 is a graph showing heat balance attained in a RCC unit as a function of Conradson carbon in the feed, water addition, and changing hydrogen content in the coke at a flue gas content of $CO_2/CO=1$.

FIGS. 2 and 3 show the effect of water addition and $CO_2/CO$ ratio on keeping the regenerator and the riser reactor section of an RCC unit in satisfactory heat balance. The maximum upper limit of water addition for economic reasons is approximately 20 wt%, the more practical is 15 wt% with a $CO_2/CO$ ratio ranging from 3/1 down to 1/1 as shown by the data of FIGS. 2 and 3, and an average hydrogen content of 5%. The Conradson carbon content of a feedstock should not be above approximately 8 wt% Conradson carbon in the feed for flue gas $CO_2/CO$ ratio of 1/1 and still maintain the RCC unit in heat balance. FIG. 2 identifies an upper Conradson carbon level of about 4 wt% when maintaining a $CO_2/CO$ ratio of 3/1 in the flue gas.

The regenerator vessel as illustrated in FIG. 1 is a simple two zone-dense fluid particle bed system. The regenerator operation is not limited however to this example but can consist of two or more zones in side by side relation. On the other hand, a single dense fluid bed contact zone in combination with a riser contact zone may be employed.

Present clay refiners are being limited to practicing reduced crude conversion processes with feedstocks containing approximately no more than about 8 wt% Conradson carbon, and this restriction necessarily excludes the use of readily available and much cheaper crude oils of higher Conradson carbon values such as Mexican Mayan.

A partial solution to the problem of excess heat in the regenerator section of a hydrocarbon processing unit such as a (RCC) reduced crude cracking unit as the Conradson carbon content of the feedstock increases above 8 wt% is to utilize a preliminary decarbonizing-demetallizing process of the kind described herein. This preliminary decarbonizing process may be relied upon to partially reduce the Conradson carbon value of a reduced crude as will as the metals content thereof so that it is more processable in a RCC unit within specific restricted operating limits. The known RCC units are temperature limited by the amount of hydrocarbonaceous material that can be burned in the regenerator section to yield a regenerated catalytic material of low residual carbon that is suitable for further use in catalytic conversion of a reduced crude feed.

A solution to the above identified problem of generating excess heat in a regenerator section as the Conradson carbon content of the feedstock increases rests in one aspect with reducing the exothermic heat released during the oxygen combustion of hydrocarbonaceous material to form carbon oxides by relying upon the endothermic reaction of $CO_2$ with carbon to remove a portion of the carbon residual of oxygen regeneration to produce carbon monoxide. At elevated temperatures and pressures, in excess of that normally encountered in a regeneration section of a decarbonizing conversion unit, the reverse reaction of carbon dioxide reacting with carbon to yield carbon monoxide is feasible. Since the feed decarbonizing unit regenerators of this invention are not employed at high temperatures in the range of 1600°–1800° F. and pressures above 100 psig up to 1000 psig, the rate of this reaction $CO_2+C$ to yield CO is very slow at a temperature of 1400° F. and 20–30 psig as normally practiced in the regenerators. However, this lower reaction rate can be substantially increased through the utilization of a select group of metal additives which will catalyze the reaction of carbon dioxide with carbon to yield carbon monoxide. As stated earlier the combustion of coke with an oxygen containing gas is an exothermic reaction. The reaction of coke with carbon dioxide to yield carbon monoxide in the presence of the select metal additive herein identified is on the other hand an endothermic reaction. Thus by maintaining a balance between oxygen partial combustion to heat the particles and carbon dioxide endothermic residual coke removal in a subsequent contact zone, the solid particle temperature in the regeneration operation whether inert or comprising catalytic activity can be controlled within a relatively narrowed and desired range of about 1350°-1500° F., and preferably in the range of about 1375°-1450° F. When effecting sorbent regeneration within these operating parameters, one can still obtain a regenerated sorbent containing carbon values below 0.5 wt%, more usually below 0.2 wt%, and preferably below about 0.1 wt%. Secondly, the combustion of hydrogen present in the hydrocarbonaceous deposits is the most highly exothermic reaction in a regenerator during the combustion of coke with air. If a reaction of carbon dioxide with hydrogen to produce water and carbon monoxide is promoted, then the overall net regeneration heat produced will be only a fraction of that produced during the oxidation of hydrocarbonaceous material with air.

A study was undertaken to determine the effectiveness of various metals to catalyze the endothermic reaction of carbon dioxide with coke on spent solid sorbents. 25 grams of a spent sorbent containing 1.1 wt% coke, was charged to a quartz reactor heated by a Lindberg split furnace. The temperature of operation was effected at 1400° F. Carbon dioxide was passed over the coked sorbent containing a select metal additive at a rate of approximately 1 cu. ft. per hour. The effluent gases were examined by a gas chromatograph to determine the amount of CO produced. This test period was for 20 minutes so that a rate of coke removal from particles could be determined that is related to the particle residence time in a regeneration process. Calculations determined that if a rate of coke removal by additive metal catalyzed carbon dioxide reaction could be accomplished up to at least 40 wt% in the 15-20 minute period, this then would allow processing of reduced crude containing up to 24 wt% Conradson carbon.

Employing the technique and equipment herein described, a series of metals from the Periodic Chart of the elements were tested. The results of these tests are reported in Tables A, B, C and D above. The best metal additives (greater than 40% coke removal) are reported in Table A, the intermediate (30-40%) are reported in Table B and least active in Table C (below 30% removal). For economic reasons it is desirable to use the cheapest of these metals and compounds thereof which will provide the results desired. The use of copper was found particularly desirable.

The next important detail was to determine the effect of metal additive concentration. This is shown for three different elements in Table F.

TABLE F

CATALYST: Sorbent with 1.1 wt % Coke
CONDITIONS: 1400° F., 30 Minutes, 25 g. Catalyst, 1 cu. ft. $CO_2$/Hr.

| Promoter | Concentration Wt % | % Coke Removed |
|---|---|---|
| Li | 1.0 | 70 |
| Li | 0.5 | 44 |
| Li | 0.33 | 35 |
| Li | 0.10 | 25 |
| Rh | 0.50 | 49 |
| Rh | 0.05 | 34 |
| Rh | 0.005 | 26 |
| Rh | 0.0005 | 17 |
| Sr | 1.0 | 45 |
| Sr | 0.5 | 30 |

In the case of the cheaper metal additives, concentration is not as important as that related to the precious metals (Pt, Pd, Rh, Ir) and the coinage metals (Ag, Au). At concentrations that are economically feasible with the precious and coinage metals it was noted that the rate of reaction is too low for a practical application in the absence of higher temperature. Utilization of thermally stable sorbents at temperatures in the range of 1500°-1600° F. in a regenerator permits one to take advantage of the higher rates shown in Tables A and B by precious metals and coinage metals at low additive concentrations. Table G shows the effect of metal concentration and temperature with a less expensive copper promoted sorbent.

TABLE G

EFFECT OF TEMPERATURE - CONCENTRATION
CATALYST : 25 g Sorbent with 1.1 wt % Coke
CONDITIONS: 30 min., 1 cu. ft. $CO_2$/Hr.

| Promoter | Concentration Wt % | Temp. °F. | % Coke Removed |
|---|---|---|---|
| $CuCL_2$ | 1.0 | 1400 | 55 |
| $CuCL_2$ | 0.5 | 1400 | 37 |
| $Cu(NO_3)_2$ | 1.0 | 1400 | 45 |
| $Cu(NO_3)_2$ | 0.5 | 1400 | 28 |
| $Cu(NO_3)_2$ | 1.0 | 1350 | 40 |
| $Cu(NO_3)_2$ | 1.0 | 1400 | 45 |
| $Cu(NO_3)_2$ | 1.0 | 1450 | 58 |

The hydrocarbonaceous material deposited on sorbent particle material during reduced crude decarbonization has been analyzed by a C-H analyzer to contain 5-6 wt% hydrogen. Under oxygen combustion or burning conditions in a sorbent regenerator, this amount of hydrogen can contribute up to 20-25% of the heat released during regeneration. Thus, if carbon dioxide could be made to react with the hydrogen present in the coke and form water, then a large amount of heat produced by oxygen combustion can be replaced with less release of heat during the carbon dioxide reaction. Thus, the reaction of carbon dioxide with hydrogen is considered important to compliment the reaction of carbon dioxide with coke for the reason described.

METAL ADDITIVES DEPOSITED DURING PROCESSING

Figure 4:
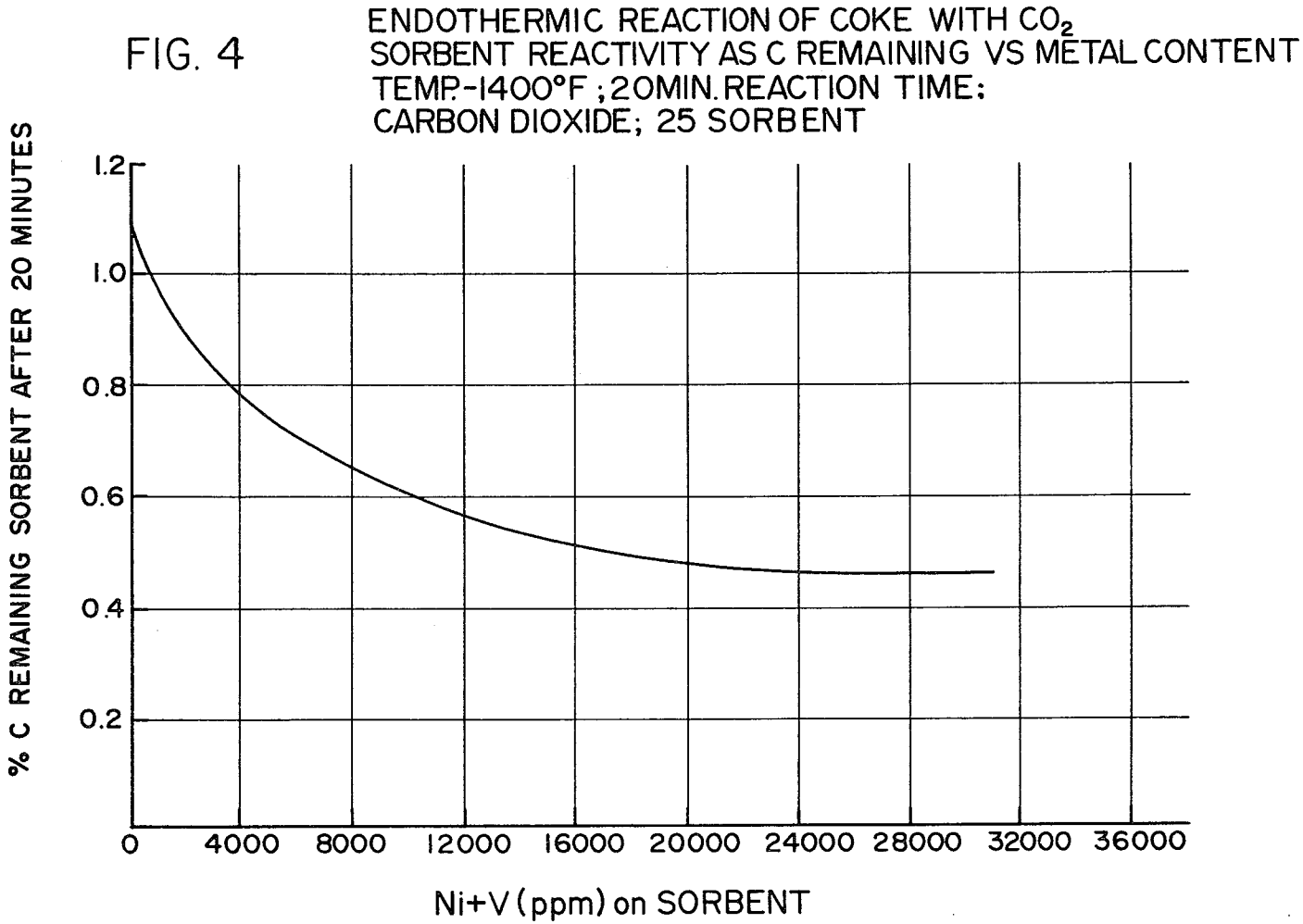
FIG. 4 is a graph showing the rate of coke removal as a function of Ni-V concentration on the sorbent.

An important aspect of this invention is directed to the utilization of the metals deposited on a sorbent particle material during processing of carbo-metallic oil containing feeds. A sorbent particle material was utilized for the processing of a reduced crude containing 100 ppm Ni+V and a Conradson carbon value between about 7-8 wt%. Sorbent particle samples were withdrawn at different times in the on stream period to examine th effect of changing concentrations of Ni+V to catalyze the endothermic removal of carbon by reaction with carbon dioxide and form carbon monoxide. The result of this series of tests are given in Table H and FIG. 4.

TABLE H

SORBENT MATERIAL
TEST CONDITIONS: 25 g. sorbent; 1400° F.; 1 cu. ft. $CO_2$ per hour

| Ni + V ppm | Coke Removal % |
|---|---|
| 3000 | 22 |
| 8000 | 40 |
| 17000 | 55 |
| 31000 | 55 |

These results indicate that at approximately 3000 ppm Ni+V (1 to 1 basis) a reasonable rate of coke removal of at least 40% and preferably 45% is not obtained and therefore is not rapid enough to treat feeds of high Conradson carbon levels. However, at higher vanadium concentrations, coke removal is increased. Furthermore, at 8,000 ppm (Ni+V) and higher vanadium concentrations, the rate is sufficient to handle the higher Conradson carbon values up to 24 wt%. The lower reaction rates however, are suitable for handling crudes of lower Conradson carbon values.

The concepts of invention herein described are useful in the treatment of high boiling hydrocarbon feeds as herein described for use in conventional FCC operations or in known or improved RCC operations where restriction of regeneration temperature is desirable. The present invention is particularly useful in the treatment of high boiling hydrocarbon feeds comprising carbo-metallic feedstock of high metals and Conradson carbon values which treated feeds are more suitable for use as feedstocks in either FCC or RCC processing units.

Although the method and process of the invention is disclosed being conducted in a vented riser reactor apparatus other types of riser separator devices suitable for providing rapid separation of the sorbent-vaporized oil suspension may be utilized. Reactors with either upward or downward solids flow apparatus means may be employed. Thus, the decarbonizing operation of the invention may be conducted with a moving bed of sorbent which moves in concurrent flow relation to liquid (unvaporized) feedstock under suitable contact conditions of pressure, temperature and weight hourly space velocity.

Having thus generally described the concepts of the present invention and discussed specific embodiments in support thereof, it is to be understood that no undue restrictions are to be imposed by reason thereof except as defined by the following claims.

We claim:

1. In a process combination for preparing premium products from residual oils comprising metal contaminants and Conradson carbon producing components by contact with solid sorbent clay particle material to lay down metal contaminants and Conradson carbon hydrocabonaceous material components on said clay particles from said residual oil before effecting fluid catalytic cracking of a resultant demetallized and decarbonized residual oil product and regenerating the solid sorbent particle material comprising substantial Conradson carbon hydrocarbonaceous material and metal deposits by combusting said hydrocarbonaceous material with an oxygen containing gas, the improvement for limiting and controlling temperatures encountered during combustion of substantial hydrocarbonaceous deposits on said solid particles which comprises:

A. initially contacting said solid sorbent clay particle material comprising hydrocarbonaceous material and metal deposits with a quantity of oxygen containing gas under conditions restricting the regeneration temperature within the range of 1350° to 1600° F. during partial removal of deposited hydrocarbonaceous material by combustion and B. removing at a sufficiently high rate greater than 40 weight percent of carbonaceous material deposits from said solid sorbent material with carbon dioxide following said initial oxidation step at temperatures up to 1600° F. while maintaining at least 0.5 weight percent of metal additive elements on said sorbent particles selected from the group comprising one or more of Li, Na, Sr, Re, Fe, Co, Ni, Ru, Rh, Pt, Pd, Os, Ir, Cu, Ag and Au during said contact with carbon dioxide.

2. The process of claim 1 wherein the endothermic reaction of $CO_2$ with carbon at a rate sufficient to remove at least 40 weight percent of carbonaceous material is implemented by the presence of Ni plus V in substantial amounts.

3. The process of claim 1 wherein said metal additive to catalyze the endothermic removal of carbon in the presence of carbon dioxide is deposited on the sorbent from a carbo-metallic containing residual oil feed.

4. The process of claim 1 wherein said metal element additive to catalyze the endothermic removal of carbon in the presence of carbon dioxide comprises a vanadium immobilization metal additive selected from the group consisting of one or more of Ti, Zr, Mn, In and Bi.

5. The process of claim 1 wherein said metal additive to catalyze the endothermic removal of carbon in the presence of carbon dioxide comprises one or a combination of metals selected from the group consisting of Fe, Co, Ni, Cu and Mo.

6. The process of claim 1 wherein said metal additive to catalyze the endothermic removal of carbon in the presence of carbon dioxide comprises copper.

7. The process of claim 1 wherein said metal additive to catalyze the endothermic removal of carbon in the presence of carbon dioxide is present in the sorbent in the range of about 0.5 to 10 wt%, preferably 1% to 5 wt% of said catalyst.

8. The process of claim 1 wherein said solid sorbent comprises a hydrated clay and has a surface area below 50 $m^2/g$ and a pore volume of at least 0.2 cc/g.

9. The process of claim 1 wherein said solid sorbent material is in spherical form and of a particle size suitable for use as fluid particles in a riser transfer zone, or for use in a moving bed contact zone.

10. The process of claim 1 wherein said solid sorbent is prepared from clays such as bentonite, kaolin, montmorillonites, smectites, 2-layered lamellar silicates, mullite, pumice, silica, laterite, or pillared interlayered clays.

11. The process of claim 1 wherein said metal element additive is initially a water soluble inorganic metal salt or a hydrocarbon soluble organo-metallic compound.

12. The process of claim 1 wherein said metal element additive is added to an aqueous slurry of the ingredients comprising said sorbent and said aqueous slurry containing said additive is spray dried to provide sorbent particles.

13. The process of claim 1 wherein said metal element additive is added to a spray dried sorbent by impregnation techniques.

14. The process of claim 1 wherein said metal additive is introduced into said solid sorbent as an aqueous solution of a metal salt or as a hydrocarbon solution of an organometallic compound at any appropriate point in the cycle flow of the sorbent.

15. The process of claim 1 wherein said metal additive is introduced onto a coked sorbent separated from the decarbonizing zone as an aqueous solution of a metal salt or as a hydrocarbon solution of an organometallic compound.

16. The process of claim 1 wherein said metal element additive is a water soluble organic metal salt selected from the group comprising a halide, a nitrate, a sulfate,, a sulfite or a carbonate or a combination of two or more said said salts.

17. The process of claim 1 wherein said metal element additive is a hydrocarbon soluble metal compound selected from the group comprising an alcoholate, ester, phenolate, naphthenate, carboxylate or a dienyl sandwich compound, and the like.

18. The process of claim 1 wherein deactivated sorbent separated from the decarbonizing zone contains from 1 to 3 wt% carbon based on weight of virgin sorbent.

19. The process of claim 1 wherein the carbonaceous deposits accumulated on said sorbent during processing of carbometallic containing residual oils contains from 2% to 10% hydrogen, and most usually from 3% to 6% hydrogen, by weight of the hydrocarbonaceous deposit.

20. The process of claim 1 wherein the residual oil feed is a reduced crude portion of a crude oil containing 200 ppm or less of metals consisting of Ni, V, Fe and Cu and having a Conradson carbon value of 6 wt% or more.

21. The process of claim 1 wherein the residual oil feed is a reduced crude portion of a crude oil containing from 20 to 600 ppm of metals consisting of Ni, V, Fe and Cu and having a Conradson carbon value of 12 wt% or more.

22. The process of claim 1 wherein the oil feed is a reduced crude portion of a crude oil containing from 50 ppm to 600 ppm of metals consisting of Ni, V, Fe and Cu of which vanadium is in major portion and having a Conradson carbon value in the range of 6 to 24 wt%.

23. The process of claim 1 wherein the residual oil feed is selected from the group consisting of vacuum gas oil, reduced crude, topped crude, vacuum gas oil containing 0 to 25 wt% of a reduced crude, whole crude oil, a residual oil comprising porphyrins, asphaltenes and polycyclic high molecular with C-H compounds, with and without combination with liquid fractions from coal liquefaction, oil shale retorting and tar sands beneficiation.

24. The process of claim 1 wherein the hydrocarbonaceous material deposited on the catalyst during carbo-metallic oil processing is in the range of 10 wt% to 28 wt% based on weight of feedstock processed.

25. The process of claim 1 wherein the oil feed product of sorbent decarbonization and demetallization treatment is thereafter utilized in a zeolite containing fluid catalytic cracking process.

26. The process of claim 1 wherein a liquid oil product of solid sorbent decarbonization step comprises less than 100 ppm Ni+V and less than 8 wt% Conradson carbon and is utilized as feed in a reduced crude cracking process.

27. The process of claim 1 wherein the oil product of solid sorbent decarbonization treatment contains from 50 to 100 ppm of Ni+V metals and less than 10 wt% Conradson carbon.

28. The process of claim 1 wherein the regeneration zone comprises two or more fluidized beds of solid sorbent particle contact material stacked one above the other or in a side-by-side relationship.

29. The process of claim 1 wherein regeneration of solid sorbent particle material is initially partially effected with an oxygen containing gas in an upflowing sorbent particle contact zone under conditions to restrict the temperatures thereof below about 1600° F. and produce a CO rich flue gas, the partially regenerated sorbent is thereafter contacted with $CO_2$ to remove residual carbon from the partially regenerated sorbent under catalyzed endothermic reaction conditions and regenerated sorbent is thereafter passed to said hydrocarbon feed contact zone.

30. The process of claim 1 wherein the regeneration operation comprises two or more sequentially arranged homogenous fluid sorbent particle contact zones with or without a riser contact regeneration zone in combination therewith.

31. The process of claim 1 wherein a CO reaction product of carbon with $CO_2$ is passed upwardly through the sorbent being partially regenerated with oxygen containing gas.

32. The process of claim 1 wherein carbon dioxide used in completing regeneration of sorbent material is a product of combustion of carbonaceous material and CO.

33. The process of claim 1 wherein the carbon dioxide containing gas is a flue gas substantially freed of CO and obtained from an FCC operation.

34. The process of claim 1 wherein the carbon dioxide containing gas is a product of the CO rich flue gas of claim 33.

35. The process of claim 1 wherein the carbon dioxide containing gas is a flue gas product of a CO boiler attached to a regeneration process.

36. The process of claim 1 wherein the carbon dioxide containing regeneration gas is a flue gas which contains less than combustion supporting amounts of carbon monoxide.

37. The process of claim 1 wherein a flue gas from said sorbent regeneration operation is processed in a CO boiler to lower the CO content to less than 1 vol% and more usually less than 0.5 vol%.

38. The process of claim 1 wherein the rate of exothermic combustion with air and the rate of endothermic reaction between carbon and carbon dioxide are balanced to restrict the regeneration temperature not to exceed 1500° F.

* * * * *